US008246213B2

(12) United States Patent
Fu et al.

(10) Patent No.: US 8,246,213 B2
(45) Date of Patent: Aug. 21, 2012

(54) HIGH POWER LED LAMP

(75) Inventors: Dejun Fu, Zhejiang (CN); Xiaoming Fang, Zhejiang (CN); Xiao Wang, Zhejiang (CN); Guangyao Su, Zhejiang (CN)

(73) Assignee: Zhejiang Mingchuang Opto-Electronic Technologh Co., Ltd., Jinhua, Zhejiang Province (CN)

( * ) Notice: Subject to any disclaimer, the term of this patent is extended or adjusted under 35 U.S.C. 154(b) by 442 days.

(21) Appl. No.: 12/663,281

(22) PCT Filed: Jun. 6, 2008

(86) PCT No.: PCT/CN2008/071221

§ 371 (c)(1),
(2), (4) Date: Dec. 6, 2009

(87) PCT Pub. No.: WO2008/148360

PCT Pub. Date: Dec. 11, 2008

(65) Prior Publication Data

US 2010/0176706 A1 Jul. 15, 2010

(30) Foreign Application Priority Data

Jun. 7, 2007 (CN) ..... 2007 1 0069222

(51) Int. Cl.
*F21V 29/00* (2006.01)

(52) U.S. Cl. ..... 362/294; 362/345; 362/373

(58) Field of Classification Search ..... 362/294, 362/345, 373, 547, 126, 218, 580, 264
See application file for complete search history.

(56) References Cited

U.S. PATENT DOCUMENTS 7,144,140 B2 * 12/2006 Sun et al. ..... 362/373
7,255,460 B2 * 8/2007 Lee ..... 362/294
7,396,146 B2 * 7/2008 Wang ..... 362/294
7,810,957 B2 * 10/2010 Zeng et al. ..... 362/294
2006/0215408 A1 * 9/2006 Lee ..... 362/294
2008/0037255 A1 * 2/2008 Wang ..... 362/294

OTHER PUBLICATIONS

PCT/CN2008/071221, CN, International Preliminary Report on Patentability.
PCT/CN2008/071221, CN, Written Opinion of the International Search Authority.

* cited by examiner

*Primary Examiner* — Bao Q Truong
(74) *Attorney, Agent, or Firm* — Global IP Services; Tianhua Gu

(57) ABSTRACT

A high-power LED lamp, including: a shell, a light-emitting assembly, heat dissipating fins, the light-emitting assembly includes a reflective bowl, a LED and a lens, characterized in that, the heat dissipating fins are radially installed in the channel of the shell, the outer end of each heat dissipating fins is connected with the inner wall of the shell, with the inner end linked to the outer wall of a circular cylinder, all of the front end faces of the heat dissipating fins form a cone-shaped concave torus, the reflective bowl is provided on the cone-shaped concave torus; the axis of the circular cylinder coincides with the axis of the shell, the front end face of the circular cylinder is planar, and the LED and the lens are installed on the surface. Compared with the prior art, the radially fenced-shaped heat-dissipating fins communicating from the front to the rear are provided in the shell, which will be more conducive to the air ventilation around the heat-dissipating fins, as well as heat transfer, and remove the heat generated by the LED nodes in time to improve the effect of heat dissipation.

10 Claims, 2 Drawing Sheets

HIGH POWER LED LAMP

CROSS REFERENCE TO RELATED PATENT APPLICATIONS

This patent application is the US national stage of PCT/CN2008/071221 filed on Jun. 6, 2008, which claims priorities of the Chinese patent applications No. 200710069222.9 filed on Jun. 7, 2007, which application is incorporated herein by reference.

FIELD OF THE INVENTION

The present invention relates to a high power LED lamp, and more particularly to a heat-dissipating structure thereof.

BACKGROUND OF THE INVENTION

In recent years, LED lamp has experienced fast growth, due to its many advantages, like low power consumption, long service life, energy conservation and environmental friendliness, which are becoming more and more socially attractive. Current LED lamp generally comprises a lamp shade, a lamp holder, a reflector, a bulb, a lens and a driving power supply. In general, different forms of heat dissipating fins are placed on the lamp shade to avoid the influence on the service life of the lamp due to the node of the LED lamp being overheated. With respect to a low power LED lamp, a dedicated heat-dissipating member may be dispensed with due to its low power consumption and small amount of heat generated. However, for a high power LED lamp, particularly that of a high power and requiring continuous lighting, a heat-dissipating member is indispensable. Concerning the method for providing the existing heat-dissipating member and the structure thereof, generally, sheet-like heat dissipating fins are provided around the bulb at the rear of the reflector, or heat-dissipating holes are provided on the wall of the lamp shade, in order to ensure the proper operation of the lamp by dissipating the heat generated by the node timely.

In the Chinese patent No. 200520134398, a "structure of the heat dissipating assembly for high power LED lamp" made a well attempt with regard to the problem of heat dissipation. The structure thereof comprises a seat, a light-emitting assembly and a switching power supply assembly, etc. The switching power supply assembly is fitted in the rear portion of the inner chamber of the seat. The switching power supply assembly includes an inner ring, and the light-emitting assembly is embedded in the front portion of the inner chamber in the seat. The light-emitting assembly includes a heat dissipating fin, a reflector, a high-power LED light bulb, and a lens. The heat dissipating fin is embedded in the inner ring. This is a relatively typical heat-dissipating structure, which utilizes several technical measures: first, in the periphery of the front port of the seat engaged by the reflector's step, a fastening ring is pressed. The internal threads of the fastening ring and the outer threads of the front port of the seat are pressed inside the heat dissipating fin to achieve a good heat-dissipating effect by tightly pressing against the reflector; second, a heat dissipating lamp holder is provided, in which there are two protruding ears inside the center holes thereof for installing the bulb of the lamp, and a specially made heat dissipating chip is provided in the heat dissipating lamp holder.

Therefore, it can be seen that in practice the following deficiencies exist in the above-mentioned heat-dissipating structure:

First, the heat dissipating effect is degraded, since the air could not flow in different directions around the heat dissipating fin due to the heat dissipating fin being provided within the front port (that is, the front port of the out shell) of the seat. Second, a heat dissipating lamp holder has to be provided, and a specially made heat dissipating chip has to be placed inside the dissipating lamp holder. Thus, not only is the structure complex, but also the production cost is increased.

SUMMARY OF THE INVENTION

Accordingly, to overcome the above mentioned deficiencies of the prior art, it is an object of the present invention to provide a high power LED lamp of which has a novel structure. The high power LED lamp of the present invention has the feature that the air can flow around the heat dissipating fin in many directions and mounting a specially made heat dissipating chip is not needed. Thus the structure thereof is simple; further, an especially good effect of heat dissipation is achieved.

In order to attain the object mentioned above, the present invention adopts the following technical solution:

A high power LED lamp, comprising: a shell, a light-emitting assembly and heat dissipating fins. The light-emitting assembly includes a reflective bowl, a LED and a lens, characterized in that, the heat dissipating fins are radially installed in the channel of the shell, the outer end of each heat sink is connected with the inner wall of the shell, with the inner end linked to the outer wall of a circular cylinder, all of the front end faces of the heat dissipating fins form a cone-shaped concave torus, the reflective bowl is provided on the cone-shaped concave torus; the axis of the circular cylinder coincides with the axis of the shell, the front end face of the circular cylinder is planar, the LED and the lens are installed on the plane.

Therein, a driving power supply is installed in the circular cylinder, a pressing lens cover is at the front end of the circular cylinder, a rear end cover is provided at the rear portion, and the lens is installed between the front end face of the circular cylinder and the pressing lens cover.

Therein, the shell, the heat dissipating fins, the circular cylinder, and the reflective bowl form a non-removable integral piece.

Therein, heat dissipating channels formed by fence-shaped heat dissipating fins are distributed in the areas both inside and outside of the ring of the reflective bowl.

Therein, the pressing lens cover, the circular cylinder and the rear end cover are joined into an integral sealing body by a connecting bolt.

Therein, the shell has a cylinder shape.

Therein, the shell has a multiple rhombic shape.

Therein, a positioning bracket is provided on the shell.

Therein, heat dissipating through holes are provided in the shell.

Beneficial effects: Compared to prior art, by setting interlinked and fence-shaped heat-dissipating fins, placing the LED light source and the lens in the middle of the front portion of the shell and providing the reflector on the concave torus of the periphery of the lens, a lamp similar to a fan in structure is formed. Air flow and heat transfer can be improved by connecting the cover, the heat dissipating fins, the circular cylinder and the reflector as a whole structure. Moreover, it not only facilitates the demolition, but also is particularly conducive to heat dissipation by linking the pressing lens cover and the circular cylinder and the rear end cover together with the bolt. Additionally, a more simple structure and a lower production cost are achieved due to the invention omitting special cooling chips.

Many aspects of the invention can be better understood with reference to the following drawings.

DETAILED DESCRIPTION OF PREFERRED EMBODIMENTS

Figure 1:
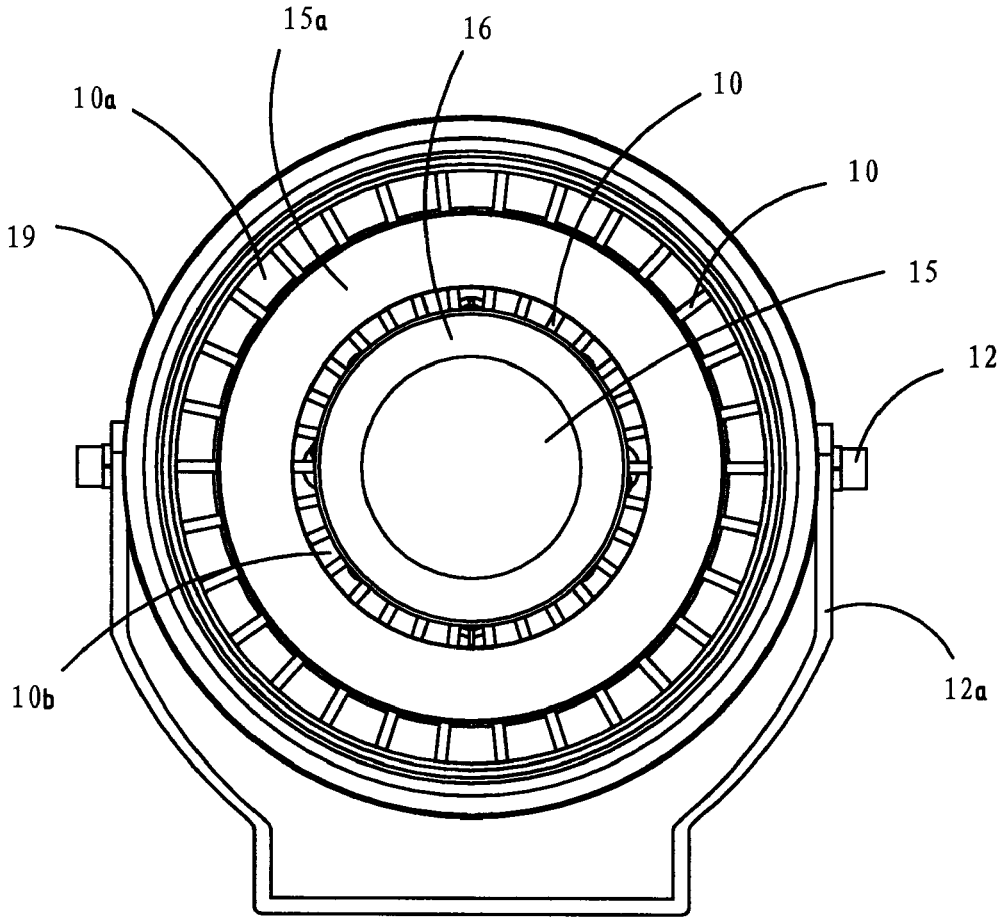
FIG. 1 is a schematic structural diagram of the invention.

The number represents respectively: connecting bolt 1, cushion 2, gasket 3, positioning block 4, rear end cover 5, fixing through hole 5*a*, input end 6, driving power supply 7, output end 8, circular cylinder 9, heat dissipating fins 10, heat dissipating channels outside the reflective bowl 10*a*, heat dissipating channels inside the reflective bowl 10*b*, washer 11, fixing bolt 12, bracket 12*a*, LED 13, anode 13*a*, cathode 13*b*, shim plate 14, lens 15, reflective bowl 15*a*, pressing lens cover 16, connecting bolts block 16*a*, sealing ring 17, fixing holes 18, shell 19, sealing ring 20, rubber sealing ring 21, sealing bolt 22.

Refer to FIG. 1, in the order of the face of the lamp from the center outwards, there are provided the lens 15, the pressing lens cover 16, the heat dissipating fins 10, the reflective bowl 15*a*, and the shell 19, and the lens 15 is pressed by the pressing lens cover 16 to a fixed location. The heat dissipating fins 10 are radially arranged. The front portion of the heat dissipating fins 10 circles the lens 15 as the center to form a cone-shaped concave ring surface, and the reflective bowl 15*a* is provided on the plane. The heat dissipating fins are distributed around the inside region and outside region of the reflective bowl 15*a*, as well as the outside heat dissipating channels 10*a* and the inside heat dissipating channels 10*b* surrounded by the adjacent heat dissipating fins 10. This structure is simple but air can flow around freely to improve heat dissipation (which is the most important innovations of the present invention). Based on this innovation, whether the width of the reflective bowl 15*a*, the taper of the ring surface of the conical concave formed by the front end surfaces of all the heat dissipating fins heat dissipating channels, the width of the upside heat dissipating channels 10*a* and the inside heat dissipating channels 10*b* are required to be set may be considered and adjusted in connection with the curvature of the lens 15.

Whether to set the bracket 12*a* on the shell 19 may be a result of the use of the lamp. For example, a tunnel lamp is assembled with bracket 12*a* because through the fixing hole 18 it can be fixed in proper position, additionally, the lamp body can rotate around the fixing bolt 12 by 360-degrees to adjust the lighting angle.

Figure 2:
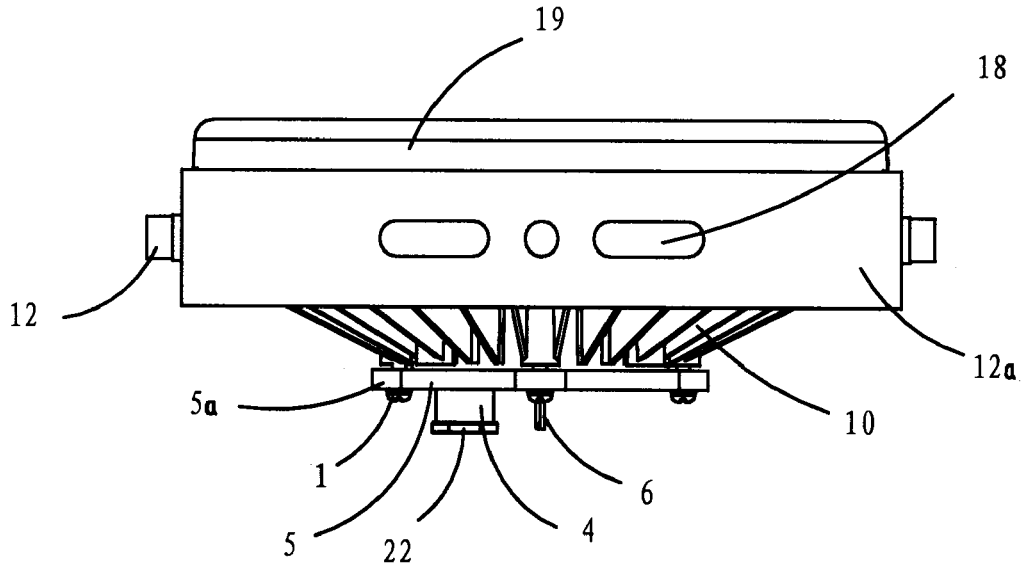
FIG. 2 is a bottom view of FIG. 1, with the brackets not shown.

FIG. 2 is a bottom view of FIG. 1. Since the power supply assembly and the lamp body form an integral structure, the circular-cylinder in the middle portion of the shell is relatively thick, and the rear-end face of the heat dissipating fins 10 can be properly extended to cover the entire outer wall of the circular-cylinder to dissipate heat generated by the driving power supply circuit. Refer to FIG. 2, the rear end cover 5 is fixed by the connecting bolt 1 via the through hole 5*a*. The sealing bolt 22 has a through hole in the middle portion, which is mainly used for leading out the input end wire of the driving power supply in a sealed condition. Detailed structure will be further explained by FIG. 3.

Figure 3:
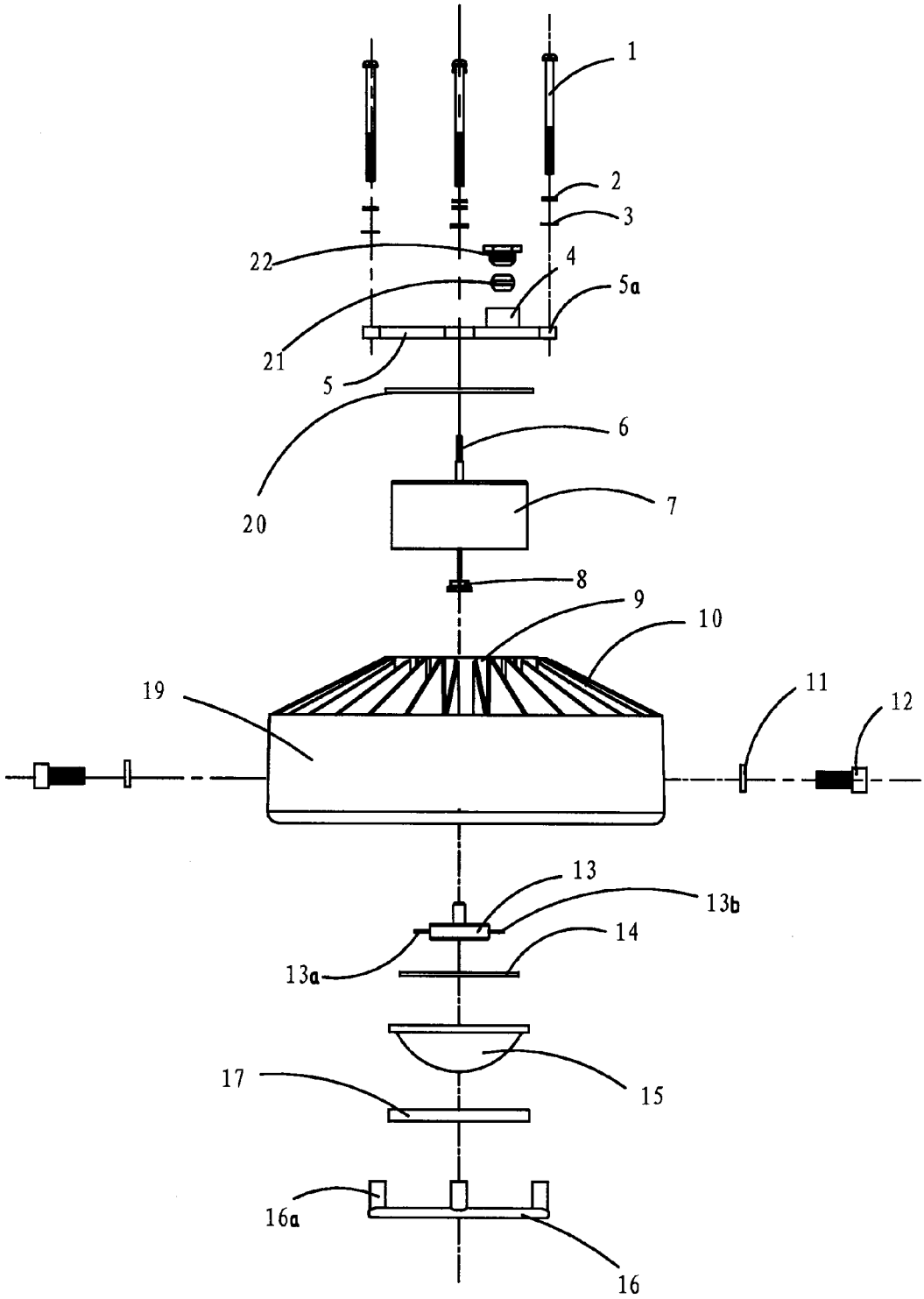
FIG. 3 is an exploded view of the parts in FIG. 1, with the brackets not shown.

FIG. 3 is an exploded view of parts in FIG. 1, with the brackets not shown.

The shell 19 is ring-shaped (Depending on the situation it can also be designed to be square shaped, pentagon-pentagonal and multi-row angular-shaped etc). On both sides of the walls there are threaded holes for receiving the fixing bolt 12, and the threaded holes include internal threads, by which the bracket 12*a* is tightly fitted and positioned, after which the bracket 12*a* can rotate by 360 degrees around the fixing bolt 12 to adjust the lighting angle of the lamp body. Some heat-dissipating through holes also can be set on the wall as needed in order to increase the flowing channels of air in the right and left direction. The radial heat dissipating fins 10 are axially arranged inside the shell 19. The outer end thereof is connected to the inner wall of the shell 19, and the inner end is connected to the circular cylinder 9, which has a fence shape, to form an air chute between adjacent heat dissipating fins 10.

Upon the implementation, the circular cylinder 9 has two setting forms. One is to install the driving power supply 7 into the cylinder 9 directly; another way is to separately provide the driving power supply 7 and the circular cylinder 9, then lead the power output line to the circular cylinder 9 which is electrically connected with LED 13. In this way, the circular cylinder 9 may be smaller in diameter and its axial length can be shorter. The first way is adopted in this embodiment, that's to install the driving power supply 7 into the circular cylinder 9 directly.

In FIG. 3, the circular cylinder 9 is for receiving the driving power supply 7. Output end 8 of the driving power supply 7 is connected to the anode 13*a*, and the cathode 13*b* of the LED 13 respectively. The LED13 is fixed in the front end of the circular cylinder 9. In the middle portion of the circular shim plate 14, there is a central through hole for receiving the LED13. Bottom ring edges of the lens 15 can be inserted into the ring in the front end of the circular cylinder 9. The pressing lens cover 16 is ring shaped and the lens 15 can be extended from the middle portion thereof. Connecting bolts block 16*a* is for receiving a connecting bolt, and the sealing ring 17 is arranged at the contact plane between the pressing lens cover 16 and the bottom ring edge of the lens 15.

After the driving power supply 7 is fixed inside the ring-shaped cylinder 9, the lead wire of the power supply input end 6 is placed on the positioning block 4 through the rear end cover 5, and the rear power supply is pulled out from the through hole in the middle portion of the sealing rubber sealing ring 21 and the sealing bolts 22. There are six fixing through holes 5*a* on the back end cover 5 to respectively receive 6 connecting bolts 1. Six connecting bolts 1 are suspended on the block 16*a* after going the six through holes 5*a*. Associated components are fixed and sealed inside the circular cylinder 9, while the lens 15 are fixed in the front end of the ring-shaped cylinder 9.

The key innovation of this invention is the arrangement of heat dissipating fins 10 to achieve the effect of all around ventilation. Various high power LED with similar structure like tunnel lights, floodlights and street lights and so on can also take above mentioned design. Of course, those skilled in the art by referring to the lights in this patent may design various new structures, such as curved front and rear ventilation structure. But this deformation of high-power LED lamp also should be covered by the scope of protection of the present invention.

What is claimed is:

1. A high-power LED lamp including:

a shell (19), a light-emitting assembly, and heat dissipating fins (10);

the light-emitting assembly includes a reflective bowl (15*a*), a LED (13) and a lens (15;

the heat dissipating fins (10) are radially installed in a channel of the shell, an outer end of each one of the heat dissipating fins (10) is connected with an inner wall of the shell (19), with an inner end linked to an outer wall of a circular cylinder (9), all of front end faces of the heat dissipating fins (10) form a cone-shaped concave torus, the reflective bowl (15*a*) is provided on the cone-shaped concave torus;

an axis of the circular cylinder (9) coincides with an axis of the shell, a front end face of the circular cylinder (9) is a plane, and a LED (13) and a lens (15) are installed on the plane.

2. The high-power LED lamp of claim 1, wherein a driving power supply (7) is installed in the circular cylinder (9), a pressing lens cover (16) is at the front end of the circular cylinder (9), a rear end cover (5) is provided at the rear portion, the lens (15) is installed between the front end face of the circular cylinder (9) and the pressing lens cover (16).

3. The high-power LED lamp of claim 1, wherein the shell (19), the heat dissipating fins (10), the circular cylinder (9), and the reflective bowl (15*a*) form a non-removable integral piece.

4. The high-power LED lamp of claim 1, wherein heat dissipating channels formed by the fence-shaped heat dissipating fins are distributed in areas both inside and outside of a ring of the reflective bowl (15*a*).

5. The high-power LED lamp of claim 2, wherein the pressing lens cover (16), the circular cylinder (9) and the rear end cover (5) are joined into an integral sealing body by a connecting bolt (1).

6. The high-power LED lamp of claim 1, wherein the shell (19) has a cylinder shape.

7. The high-power LED lamp of claim 1, wherein the shell (19) has a multiple rhombic shape.

8. The high-power LED lamp of claim 1, wherein a positioning bracket is provided on the shell (19).

9. The high-power LED lamp of claim 1, wherein heat dissipating through holes are provided in the shell (19).

10. The high-power LED lamp of claim 2, wherein the shell (19), the heat dissipating fins (10), the circular cylinder (9), and the reflective bowl (15*a*) form a non-removable integral piece.

* * * * *